US007905041B1

(12) United States Patent
Davies

(10) Patent No.: US 7,905,041 B1
(45) Date of Patent: Mar. 15, 2011

(54) STABILIZED RIFLE BARREL AND RIFLE

(76) Inventor: Robert B. Davies, Tempe, AZ (US)

( * ) Notice: Subject to any disclaimer, the term of this patent is extended or adjusted under 35 U.S.C. 154(b) by 630 days.

(21) Appl. No.: 11/864,966

(22) Filed: Sep. 29, 2007

Related U.S. Application Data

(60) Provisional application No. 60/848,124, filed on Sep. 29, 2006.

(51) Int. Cl.
*F41A 21/48* (2006.01)

(52) U.S. Cl. ..... 42/75.02; 89/14.1

(58) Field of Classification Search ..... 42/143, 42/75.02; 89/14.1
See application file for complete search history.

(56) References Cited

U.S. PATENT DOCUMENTS 2,375,721 A * 5/1945 Woodhull ..... 89/149
2,816,484 A * 12/1957 Grages ..... 89/194
5,540,008 A * 7/1996 Kirnstatter ..... 42/75.02
6,671,990 B1 * 1/2004 Booth ..... 42/75.01
2005/0188590 A1 * 9/2005 Baber et al. ..... 42/75.02
* cited by examiner

*Primary Examiner* — Stephen M Johnson
(74) *Attorney, Agent, or Firm* — Parsons & Goltry; Robert A. Parsons; Michael W. Goltry

(57) ABSTRACT

A firearm includes a support block having a forward end and a rearward end, and carrying a receiver on a top surface thereof. A rearward barrel guide having a thrust coupling extending radially outwardly therefrom, the thrust coupling engaging an engagement element located at the forward end of the support block, thereby aligning the rearward barrel guide with the support block. Also provided is a barrel having a breech end and a muzzle end, the breech end is received through the rearward barrel guide and coupled to the receiver. A forward barrel guide is fixed to the barrel intermediate the muzzle end and the breech end. A handguard assembly is received over the barrel and coupled to the rearward barrel guide and the forward barrel guide, stabilizing the barrel.

20 Claims, 13 Drawing Sheets

STABILIZED RIFLE BARREL AND RIFLE

This application claims priority from U.S. application 60/848,124 as filed on Sep. 29, 2006.

FIELD OF THE INVENTION

This invention relates to firearms.

More particularly, the present invention relates to firearms with removable barrels.

BACKGROUND OF THE INVENTION

In the field of firearms, and in particular rifles, accuracy is of extreme importance and is a characteristic easily affected by changes in the firearm. Of paramount importance is preventing barrel deflection. Any deviations in the barrel, such as caused from vibration, oscillations and the like, will change the flight path of a bullet. As the distance the bullet travels increases, the deviation increases. Thus a small change in the barrel orientation can result in large deviations from the desired point of impact. Accuracy in a rifle is typically determined by the distribution of bullet impact points on a target. A small grouping indicates greater accuracy than a larger grouping. Any change in the barrel itself or with respect to the rest of the firearm will adversely affect accuracy by preventing small groups due to the variability of the bullet flight path. Many firearms have been developed to increase accuracy, by stabilizing the barrel. However these systems do not permit easy removal of a barrel and make use of accessory devices difficult.

It would be highly advantageous, therefore, to remedy the foregoing and other deficiencies inherent in the prior art.

An object of the present invention is to provide an accurate firearm with easily removable barrel.

Another object of the present invention is to provide an exchangeable barrel employed with a full rail and handguard assembly.

Yet another object of the present invention is to provide a stabilized barrel system.

SUMMARY OF THE INVENTION

Briefly, to achieve the desired objects of the instant invention in accordance with a preferred embodiment thereof, provided is a firearm including a support block having a forward end and a rearward end and carrying a receiver on a top surface thereof intermediate the forward end and the rearward end. A rearward barrel guide having a thrust coupling extending radially outwardly therefrom, the thrust coupling engaging an engagement element located at the forward end of the support block, thereby aligning the rearward barrel guide with the support block. Also provided is a barrel having a breech end and a muzzle end, the breech end is received through the rearward barrel guide and coupled to the receiver. A forward barrel guide is fixed to the barrel intermediate the muzzle end and the breech end. A handguard assembly is received over the barrel and coupled to the rearward barrel guide and the forward barrel guide, stabilizing the barrel.

In a specific aspect, the rearward barrel guide includes a tab extending from a rear surface thereof. The tab is received in a slot formed in a forward surface of the receiver, aligning the rearward barrel guide with the receiver.

In yet another aspect, the handguard assembly includes a rearward wedge block carried between an outer surface of the rearward barrel guide and an inner surface of the handguard, and is movable between a disengaged position and an engaged position. The rearward wedge block is forced against the rearward barrel guide in the engaged position, frictionally holding the handguard assembly to the rearward barrel guide. A forward wedge block is carried between an outer surface of the forward barrel guide and an inner surface of the handguard, and is movable between a disengaged position and an engaged position. The forward wedge block is forced against the forward barrel guide in the engaged position, frictionally holding the handguard assembly to the forward barrel guide.

In a further aspect, a barrel stabilizing system for a firearm including a barrel having a muzzle end and a breech end removable coupled to a receiver is provided. The barrel stabilizing system includes an engagement element positioned relative the receiver and a rearward barrel guide having a thrust coupling extending radially outwardly therefrom. The thrust coupling engages the engagement element thereby aligning the rearward barrel guide with the receiver. The breech of the barrel extends through the rearward barrel guide and is coupled to the receiver. A forward barrel guide is fixed to the barrel intermediate the muzzle end and the breech end. A handguard assembly is received over the barrel and coupled to the rearward barrel guide and the forward barrel guide, stabilizing the barrel

BRIEF DESCRIPTION OF THE DRAWINGS

Specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
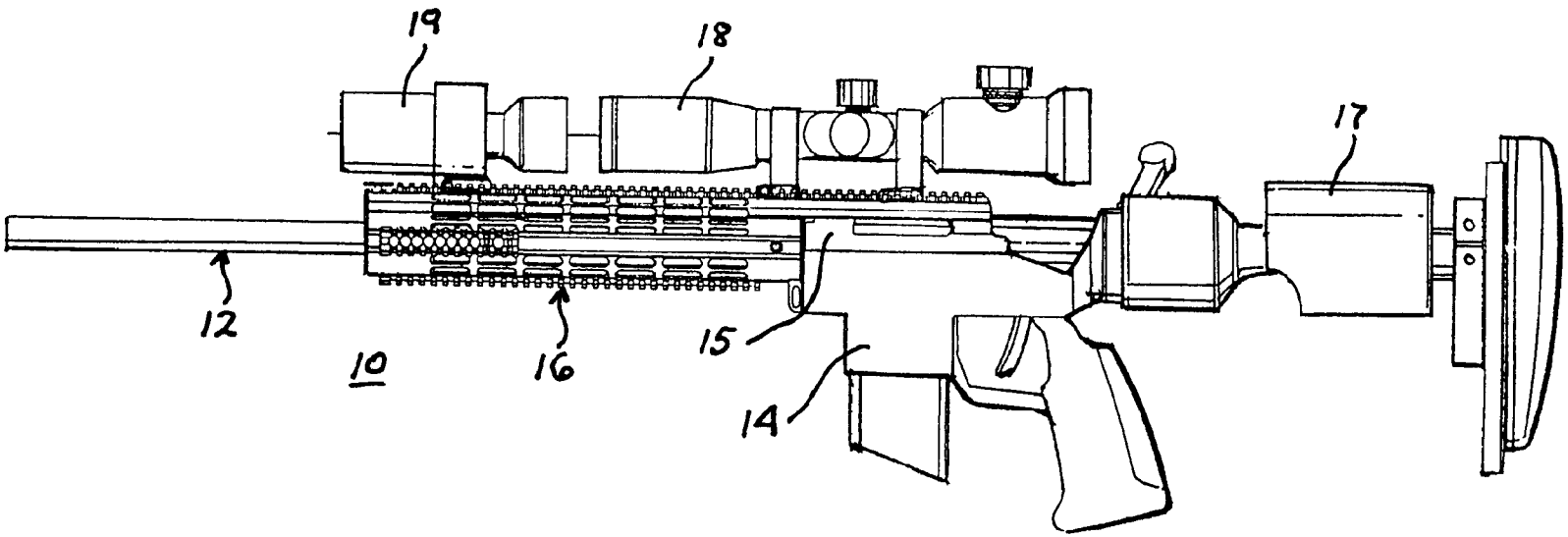
FIG. 1 is a side elevational view of a rifle according to the present invention.
Figure 2:
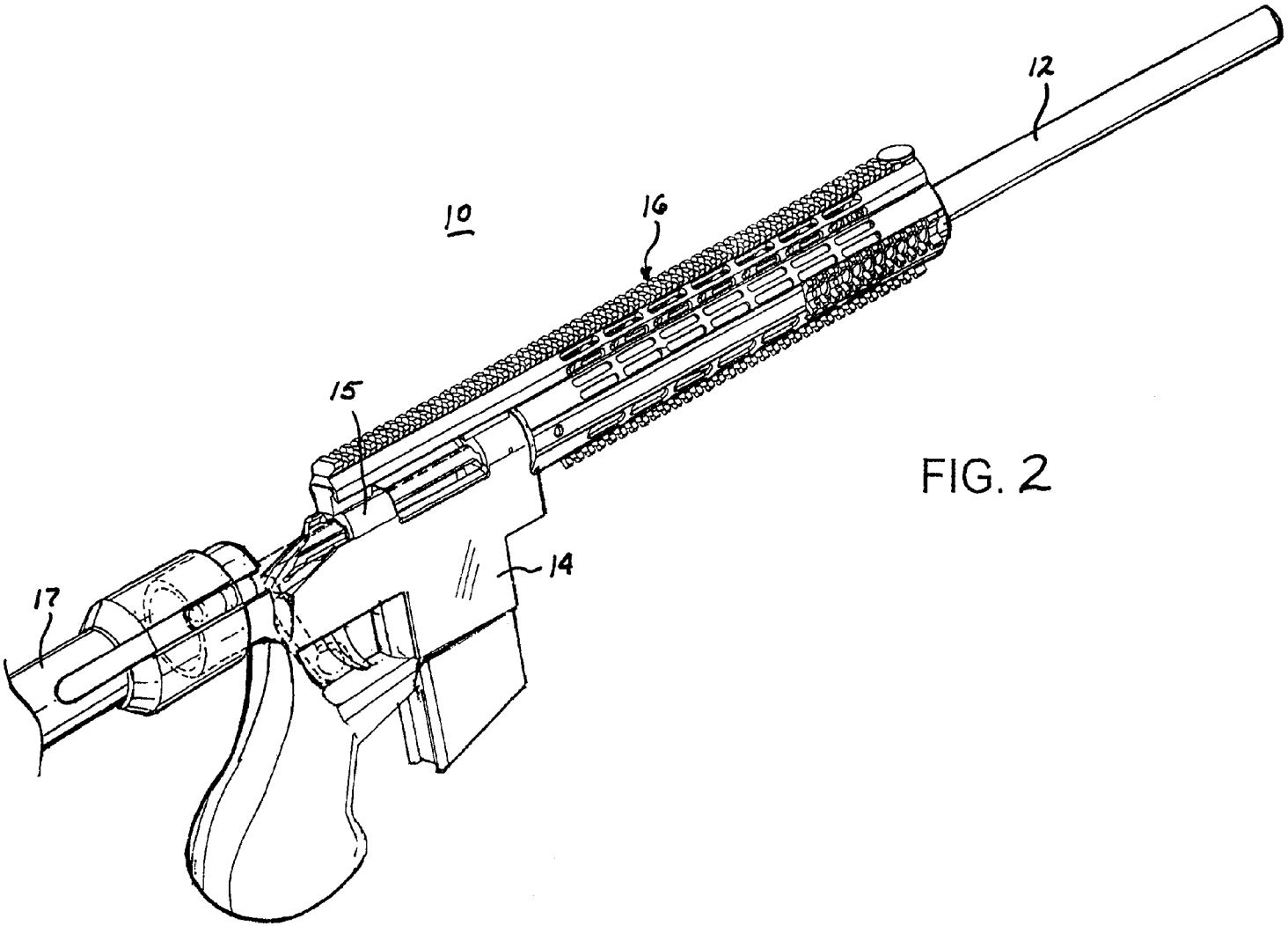
FIG. 2 is a perspective view of the rifle of FIG. 1.
Figure 3:
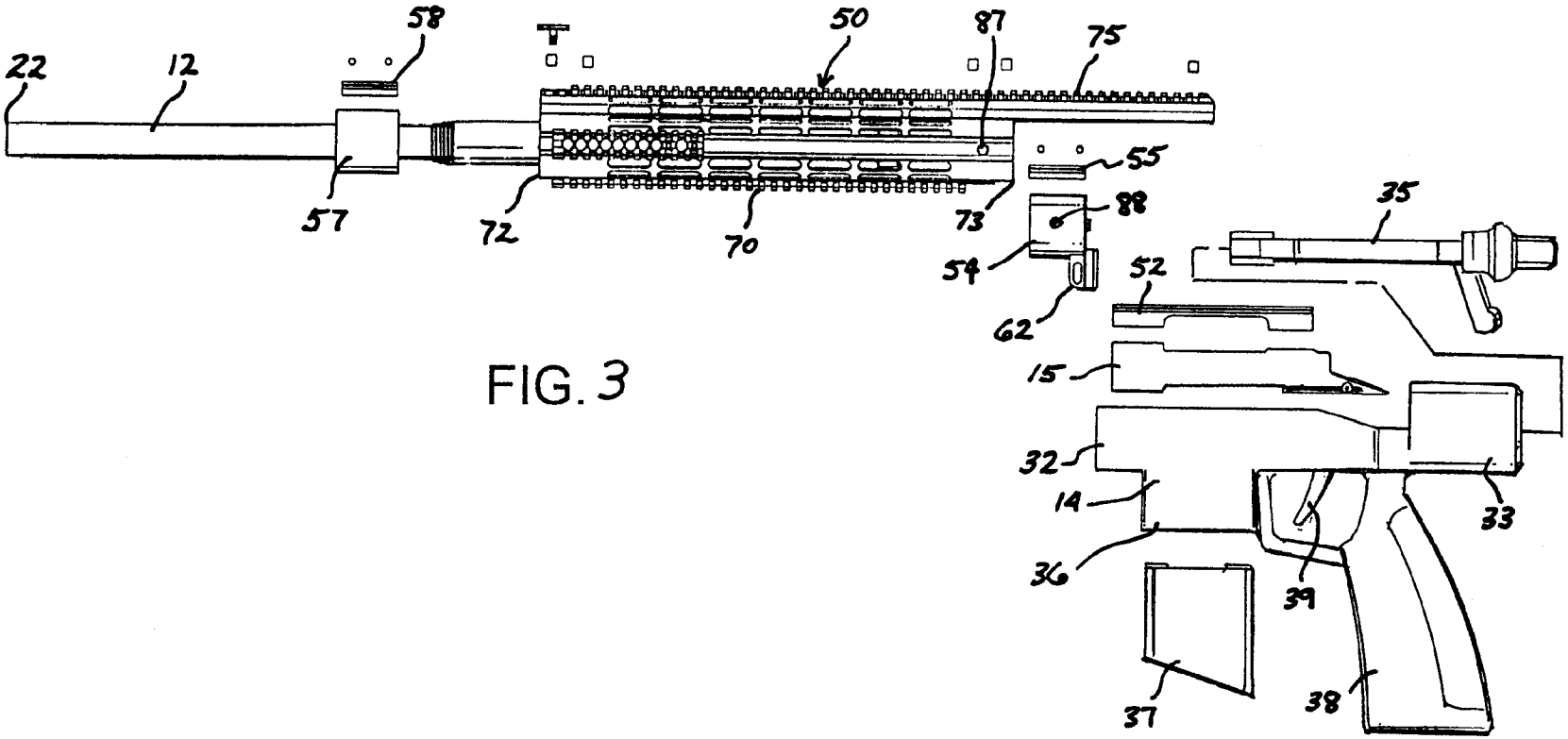
FIG. 3 is an exploded side view of a portion of the rifle of FIGS. 1 and 2.
Figure 4:
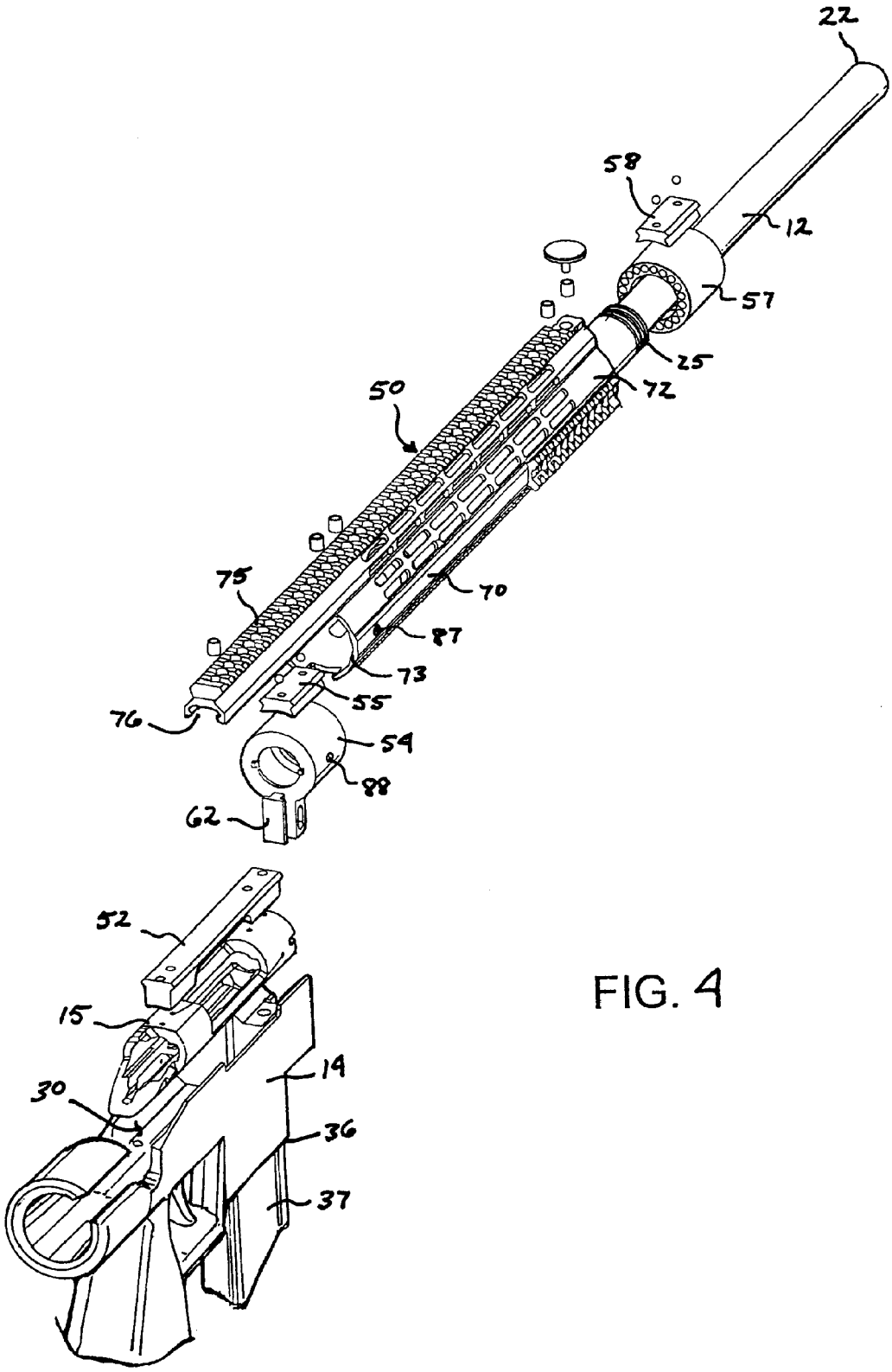
FIG. 4 is an exploded perspective view of the portion of the rifle from the rear quarter.
Figure 5:
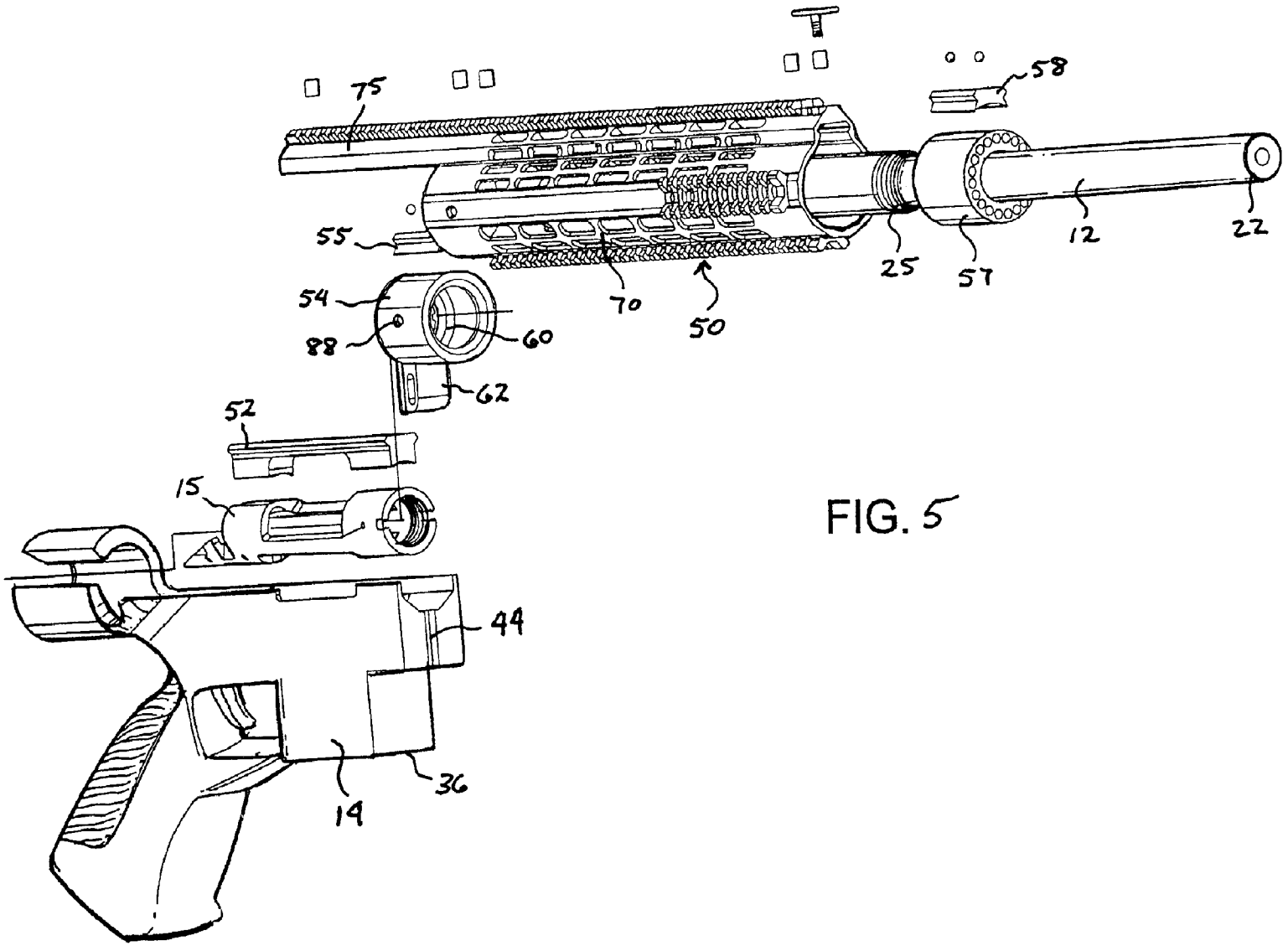
FIG. 5 is an exploded perspective view of the portion of the rifle from the front quarter.
Figure 6:
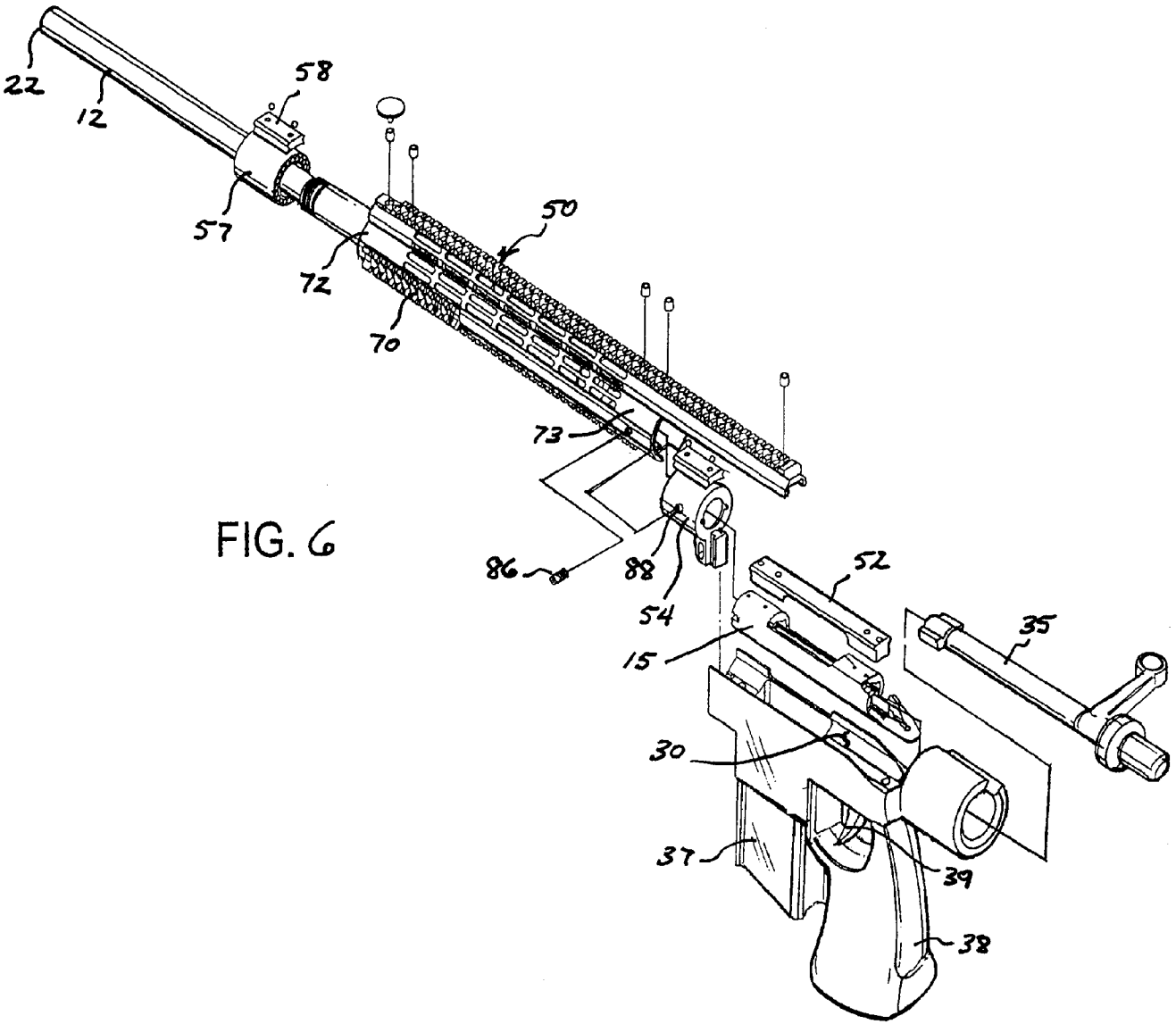
FIG. 6 is an exploded perspective view of the portion of the rifle from the top quarter.
Figure 7:
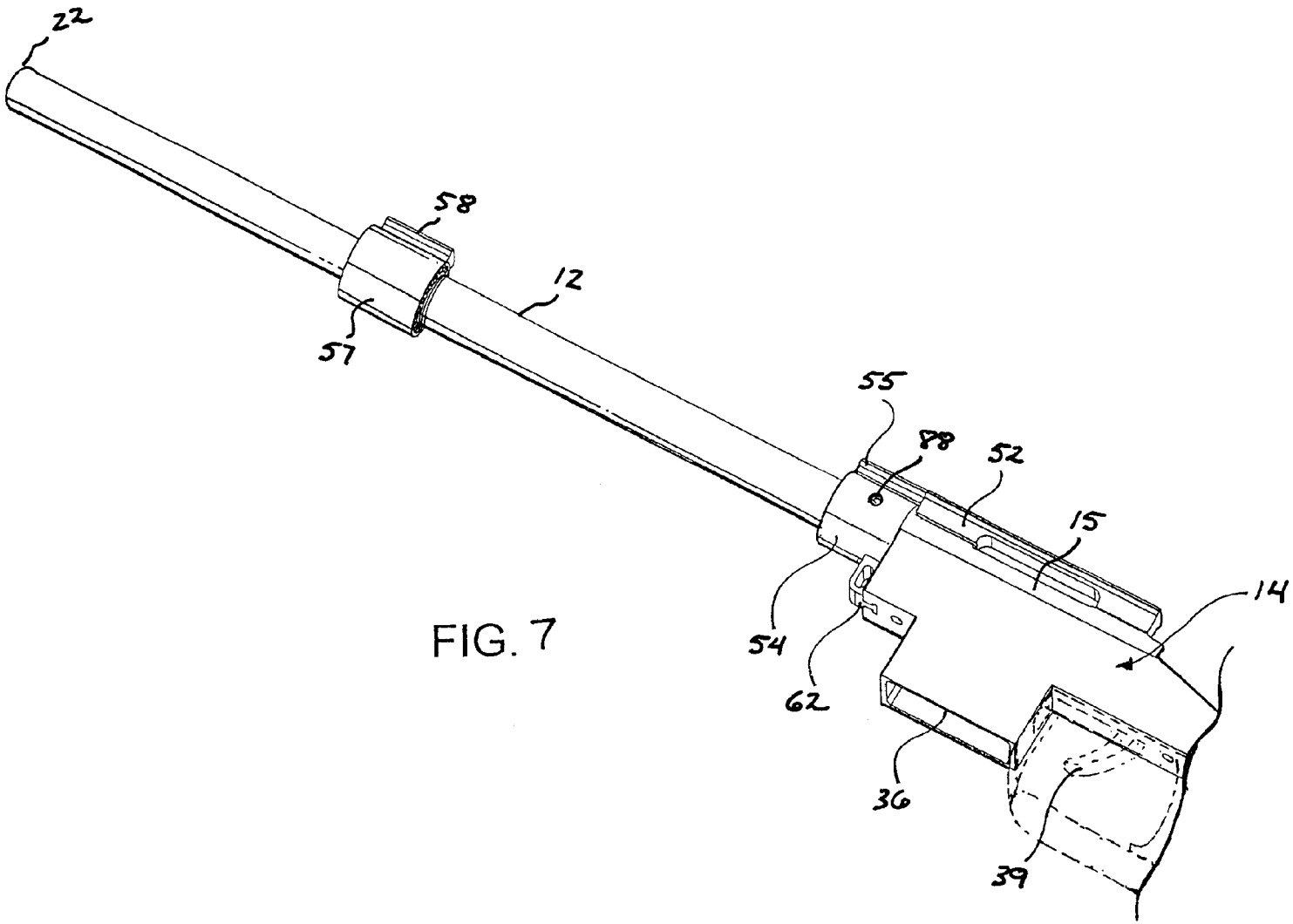
FIG. 7 is a side perspective view of the portion of the rifle with the handguard assembly removed.

Turning now to the drawings in which like reference characters indicate corresponding elements throughout the several views, attention is directed to FIGS. 1 and 2 that illustrate a rifle generally designated 10, incorporating a stabilized barrel system. Rifle 10 in this embodiment is a bolt action rifle having a barrel 12, a support block 14, a receiver 15, a barrel stabilizing system 16 and a butt stock 17. As can be seen, stabilizing system 16 preferably includes a rail which extends along a handguard and over the receiver in a common plane. This permits multiple interacting ocular devices to be mounted on the rail without the need for adjusting to different height rails, as is typical in the art. In the present embodiment, by way of example, a scope 18 is mounted on the rail with a night vision device 19 mounted in front thereof. Standard equipment such as this can be easily and quickly mounted on the rail without the need for specialized adapters and the like.

Figure 8:
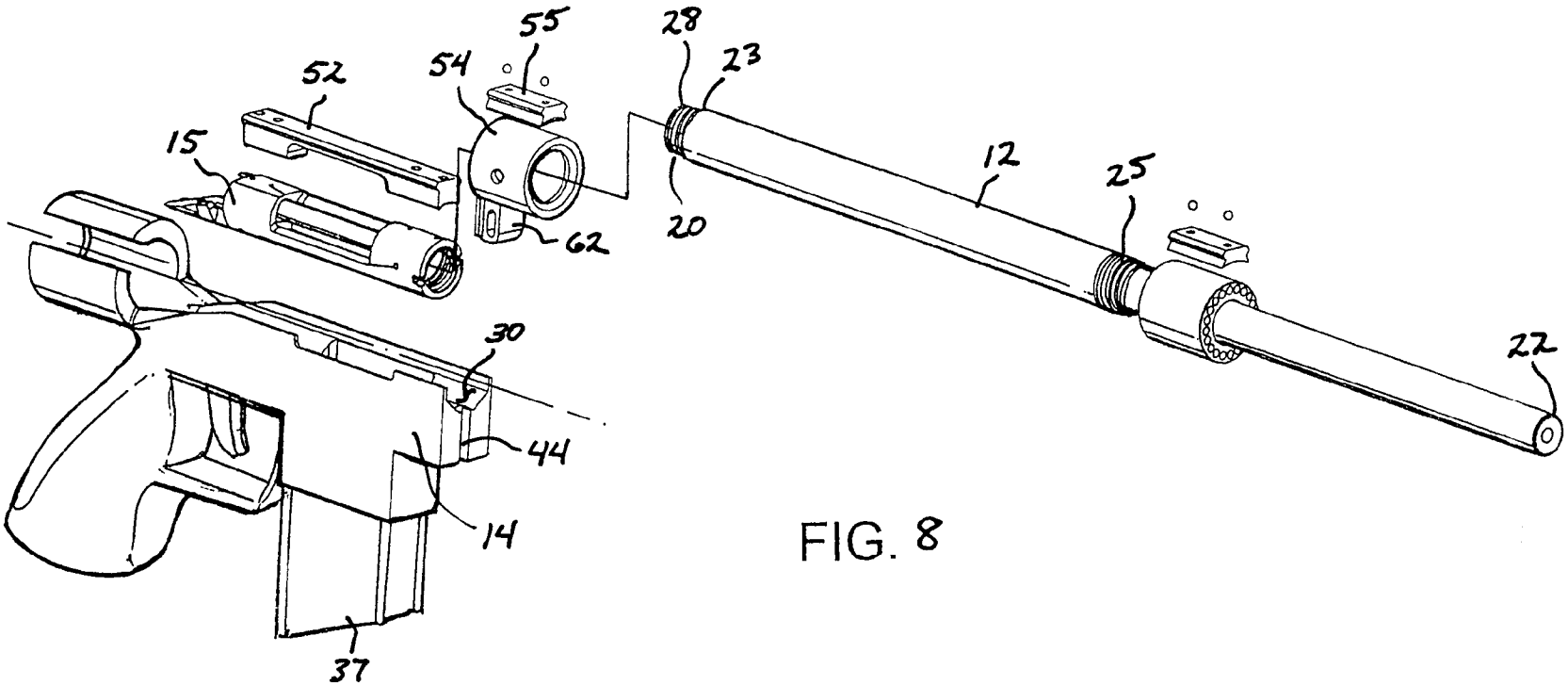
FIG. 8 is a exploded perspective view of the portion of the rifle with the handguard assembly removed.

With momentary reference to FIG. 8, barrel 12 includes a breech end 20, a muzzle end 22, a shoulder 23 formed therein proximate and directed toward breech end 20 and a shoulder 25 formed therein intermediate muzzle end 22 and breech end 20, directed toward muzzle end 22. A receiver engagement portion 28 of barrel 12, at breech end 20 rearward of shoulder 23 is provided with threading for engagement with receiver 15 in this embodiment although other engagement structures can be employed. The purposes for the structure of barrel 12 will be described presently.

Referring now to FIGS. 3-6 and 10, exploded views of rifle 10 are illustrated. Support block 14 carries receiver 15 fixedly attached thereto and includes a receiver channel 30 formed in a top portion thereof, a forward end 32 and a rearward end 33. Receiver 15 is a conventional rifle receiver, and in this embodiment is a receiver for a bolt action rifle of the type configured to receive a bolt 35. Support block 14 functions as a unifying and aligning element for the entire rifle. It is preferably fabricated of a solid piece of aluminum, although other materials such as steel may be employed, and is the basic element to which all other elements of rifle 10 align. Support block 14 also includes a magazine well 36 depending downwardly opposite receiver channel 30 and intermediate forward end 32 and rearward end 33. Magazine well 36 is of conventional design and is intended to receive magazines 37 and include the necessary latches and mechanisms for allowing retention and release thereof. In other words, a conventional structure is formed between magazine 37 carried within magazine well 36 and receiver 15. In this embodiment, a pistol grip 38 and trigger assembly 39 are attached to support block 14 rearward of magazine well 36. Drop in trigger assemblies are well known in the art and will not be described in detail herein. Rearward end 33 of support block 14, in this embodiment, is configured to receive butt stock attachment 17 (FIG. 1). It will be understood that rearward end 33 can be configured in a variety of different manners to accommodate different types of butt stocks, or none, as desired.

Figure 9:
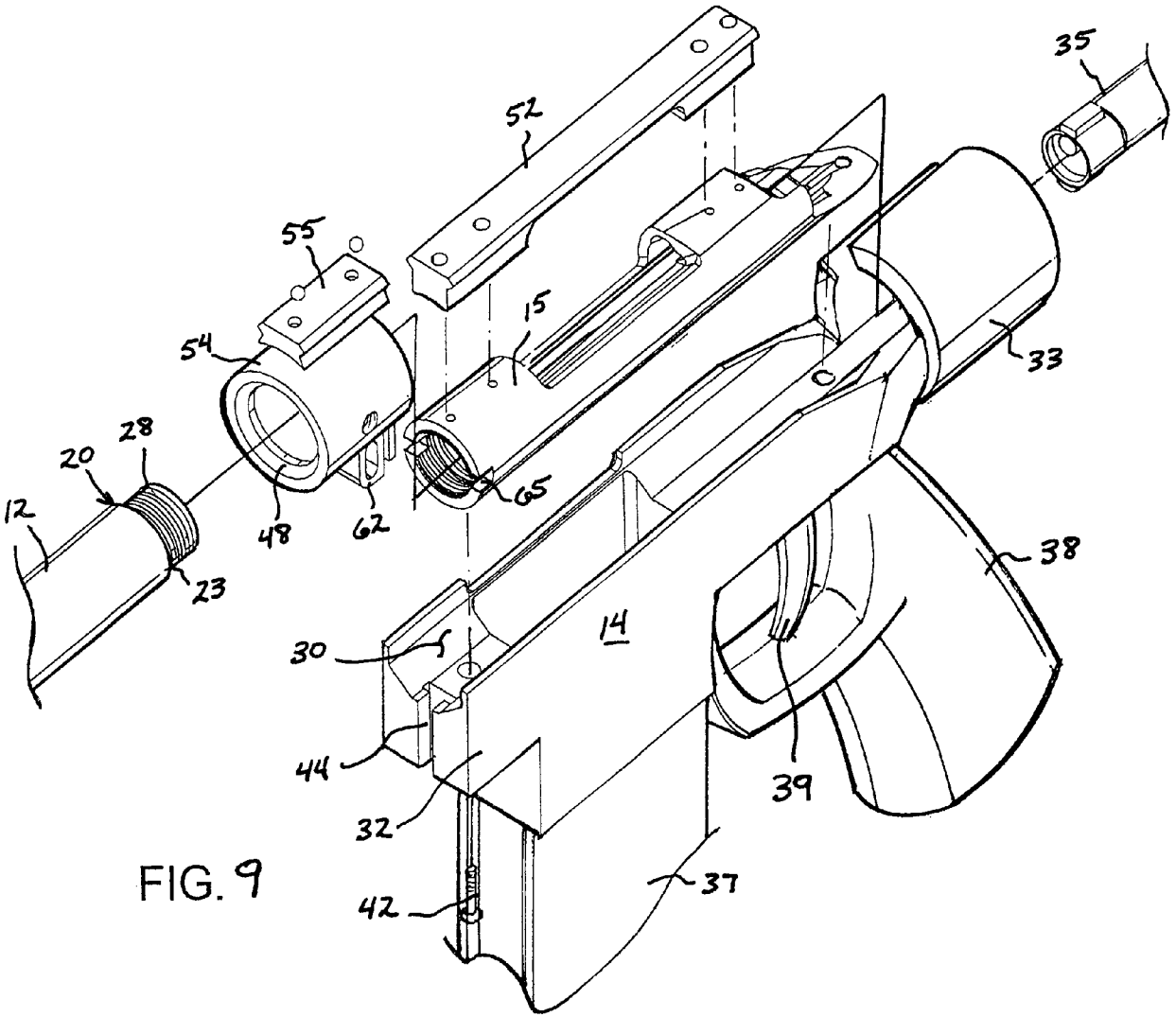
FIG. 9 is an exploded view of the support block and associated elements.
Figure 10:
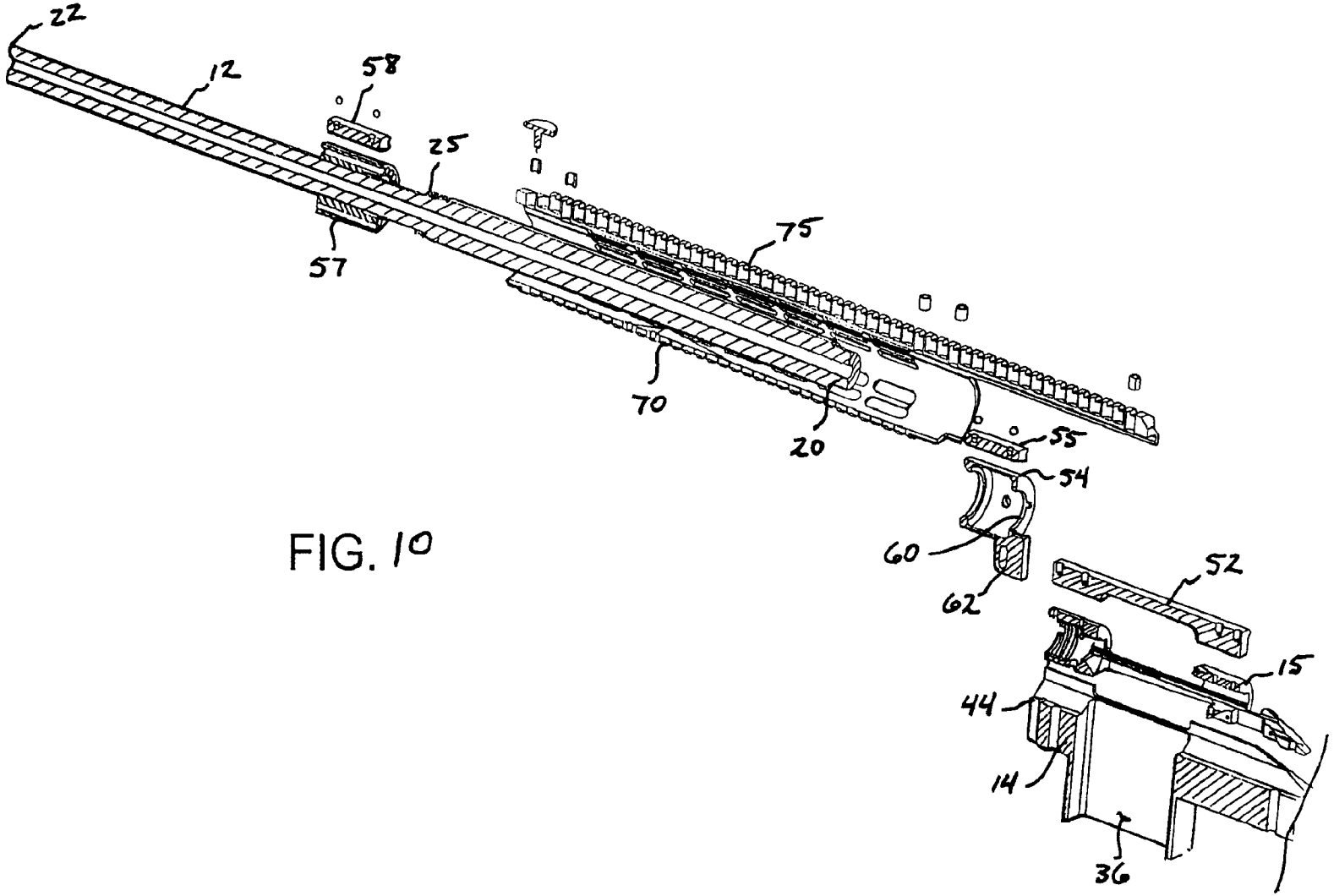
FIG. 10 is an exploded sectional side view of the portion of the rifle.

Still referring to FIGS. 3-6 and 10, with additional reference to FIG. 9, receiver 15 is fixed to support block 14 within channel 30 and extends from forward end 32 toward rearward end 33. Channel 30 is shaped to cradle receiver 15, helping to align it with support block 14. Receiver 15 can be fixed to support block 14 in any convenient manner such as bolts, adhesives, welding and the like, but is preferably attached using screws 42 extending upwardly through support block 14 proximate forward end 32 and rearward end 33 and into receiver 15 further ensuring alignment thereof. Support block 14 additionally carries an engagement element at forward end 32. In this embodiment the engagement element is a keyhole slot 44 the purpose of which will be described presently.

Barrel stabilizing system 17 of the present invention includes a handguard assembly 50, an alignment mount 52, a rearward barrel guide 54 with rearward wedge block 55 and a forward barrel guide 57 with a forward wedge block 58. Rearward barrel guide 54 includes an outer surface with an outer diameter and a bore having an inner diameter through which breech end 20 of barrel 12 extends. A flange 60 (best seen in FIGS. 5 and 10) extends radially inwardly from the rearward end of rearward barrel guide 54, providing a reduced inner diameter, and forming a thrust surface against which shoulder 23 of barrel 12 resides. Receiver engagement portion 28 of barrel 12, at breech end 20 rearward of shoulder 23, extends through rearward barrel guide 54, and is coupled to receiver 15, such as by threaded engagement.

Figure 11:
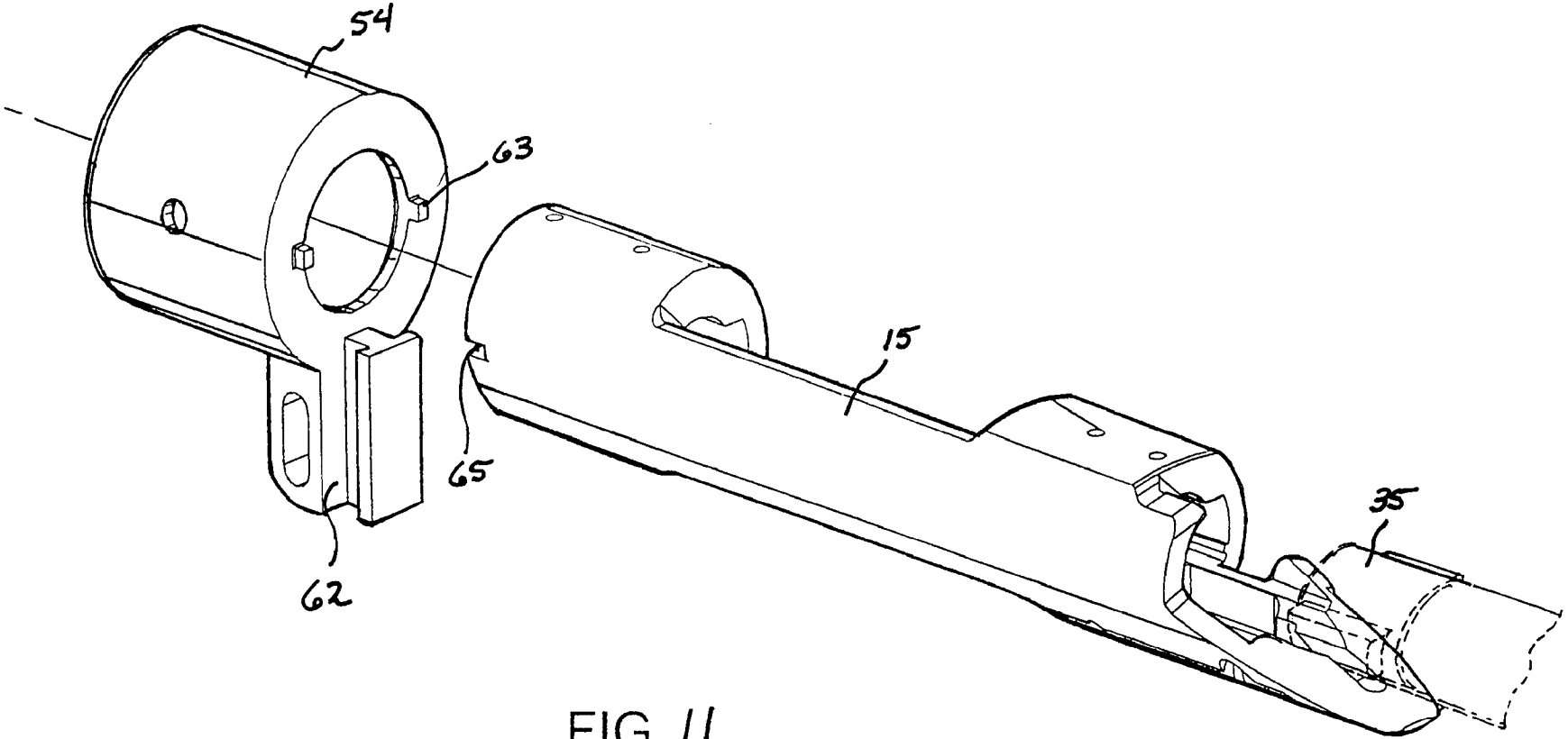
FIG. 11 is an enlarged perspective view of the receiver and rearward barrel guide.

Thus, breech end 20 of barrel 12 is coupled to receiver 15 through rearward barrel guide 54, with rearward barrel guide 54 residing adjacent, and preferably abutting, receiver 15. A thrust coupling 62 extends from rearward barrel guide 54 and is coupled to support block 14. In this embodiment, thrust coupling 62 is received within keyhole slot 44. As will be apparent from the description, any rearwardly directed forces generated by barrel 12 will be transmitted through rearward barrel guide 54 and thrust coupling 62 into support block 14. Additionally, rearward barrel guide 54 is aligned with support block 14 by keyhole slot 44, and in engagement with receiver 15. The alignment of rearward barrel guide 54 with receiver 15 is further enhanced by tabs 63 extending from the rear face thereof and received in slots 65 formed in the forward face of receiver 15 (FIG. 11). In this manner, when receiver 15 and rearward barrel guide 54 are attached to support block 14 and each engages the other, an aligned system with respect to support block 14 is provided. At this point, breech end 20 of barrel 12 is stabilized and aligned with support block 14 when it is received through rearward barrel guide 54 and threaded into receiver 15.

Forward barrel guide 57 includes an outer surface having an outer diameter, and a bore therethrough having an inner diameter. As can be seen with additional reference to FIG. 10, forward barrel guide 57 has a counter bore extending from breech end 20 toward muzzle end 22 with a greater diameter than the bore, thereby forming a shoulder therebetween. Muzzle end 22 of barrel 12 is received through the bore and counter bore with the shoulder of forward barrel guide 57 engaging shoulder 25. Forward barrel guide 57 is preferably fixed to barrel 12. In this embodiment, the inner surface of the counter bore of forward barrel guide is threaded to threadably engage corresponding threads on barrel 12 rearward of and adjacent to shoulder 25. Thus, forward barrel guide is securely attached to barrel 12 and can be further secured by the use of set screws, adhesives or the like, to prevent rotation of forward barrel guide 57 once positioned. While shoulder 25 and threads are employed to secure forward barrel guide 57 in position, it will be understood that other manners of fixedly attaching forward barrel guide 57 to barrel 12 intermediate muzzle end 22 and breech end 20 can be employed. Examples include, welding, machining directly on the barrel and the like. The current embodiment is an easily achievable and readily duplicated method.

Alignment mount 52 is coupled to the top of receiver 15 and includes a dovetail pin forming the top surface thereof. Handguard assembly 50 includes a handguard portion 70 having a forward end 72 and a rearward end 73, and a rail portion 75 along the top surface of handguard portion 70 and extending rearwardly past rearward end 73. Rail portion 75 includes a channel 76 formed in the bottom which extends the entire length of rail portion 75 including the length along the top surface of handguard portion 70. Channel 76 of rail portion 75 extending rearward of handguard portion 70 is received by the dovetail pin of alignment mount 52. Alignment mount 52 guides, aligns and supports rail portion 75. Rail portion 75 is preferably not fixed to alignment mount 52, which simply guides and aligns, and also acts as a stop to prevent excessive movement or deformation thereof.

Handguard portion 70 is generally tubular with an inner surface defining an inner volume. Channel 76 on the under-side of rail 75 extends from forward end 72 to rearward end 73 of handguard portion 70 and is a portion of the inner volume. Barrel 12 is received through handguard portion 70 such that rail portion 75 is received by and overlies alignment mount 52. Portions of the inner surface at rearward end 73 are received about rearward barrel guide 54 and portions of the inner surface at forward end 72 are received about forward barrel guide 57. Forward wedge block 58 and rearward wedge block 55 are positioned within channel 76 of the inner volume proximate forward end 72 and proximate rearward end 73, respectively. Set screws 78 enter wedge blocks 58 and 55 through rail portion 75 and allow wedge blocks 58 and 55 to be moved between a disengaged position and an engaged position, forcing wedge blocks 58 and 55 against forward barrel guide 57 and rearward barrel guide 54, respectively. By forcing wedge blocks 58 and 55 against barrel nuts 57 and 54, respectively, barrel 12 is stabilized to handguard assembly 50. Additionally, handguard assembly 50 is aligned relative support block 14 by rearward barrel guide 54 and alignment mount 52. After initial assembly and "zeroing", since barrel 12 is also aligned relative support block 14 as described previously, and then stabilized by wedge blocks 58 and 55 to handguard assembly 50, barrel 12 and rail portion 75 will always be aligned making any sighting device carried by rail portion 75 "zeroed" automatically even when barrel 12 is removed and replaced.

Forces generated by recoil of rifle 10 can potentially move handguard portion 70 in a lateral forward or rearward direction. To prevent this possibility, a stop 86 is threaded into one or more threaded apertures 87 located at rearward end 73 of handguard portion 70. Threaded apertures 87 are aligned with apertures 88 formed in rearward barrel guide 54. Stops 86 are threaded through aperture 87 in handguard portion 70 so as to extend into aperture 88, preventing relative forward and rearward movement. Stops 86 can be screws and the like.

Figure 13:
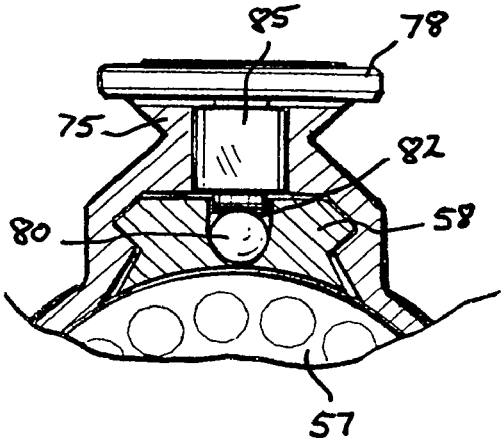
FIG. 13 is a partial sectional end view illustrating a clamping block.
Figure 12:
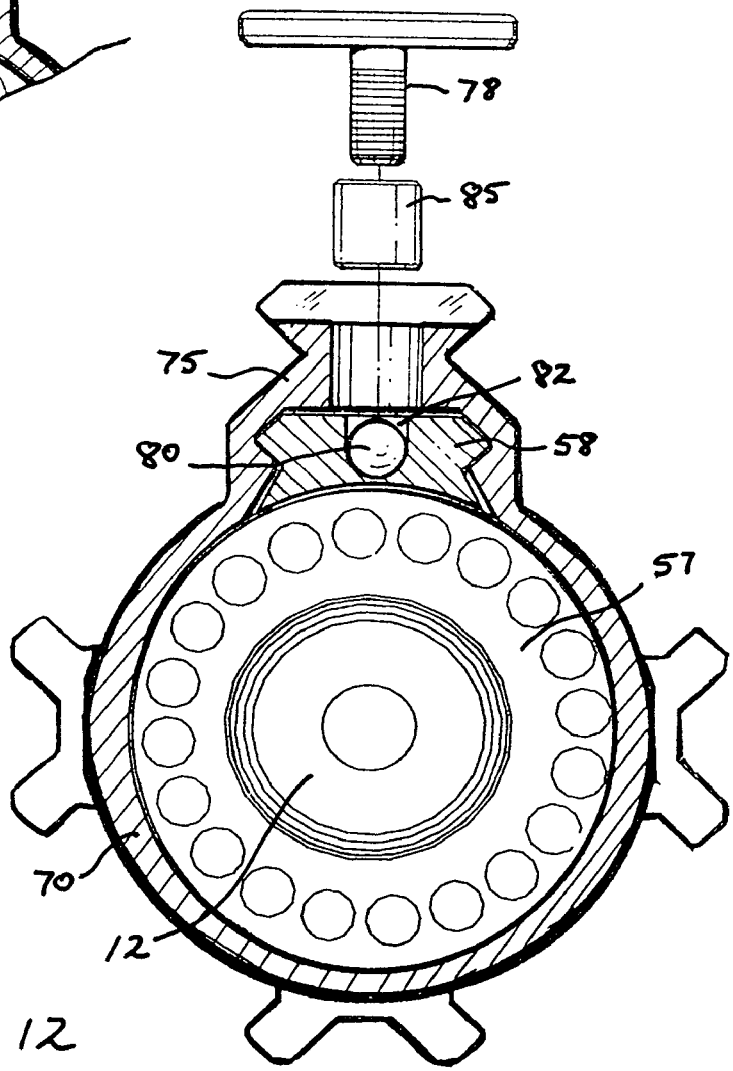
FIG. 12 is a sectional end view of the handguard assembly.

When a material such as aluminum is employed for wedge blocks 58 and 55, steel bearing balls 80 can be employed between set screws 78 (can also be thumb screws for easy removal) and wedge blocks 55 and 58 to diffuse the pressure from set screws 78 and prevent damage to wedge blocks 55 and 58, as illustrated in FIGS. 12 and 13. In this instance, a seat or pair of seats 82 with a radiused bottom is formed in each wedge block 55 and 58. To protect rail 75, when constructed of a softer material such as aluminum, steel sleeves 85 can be inserted into the set screw apertures. Thus, set screws 78 are threaded into sleeves 85 and engage bearing balls 80 and forcing them against the radiused bottom of seats 82, thereby forcing wedge blocks 55 and 58 securely against barrel nuts 54 and 57, respectively.

Figure 14:
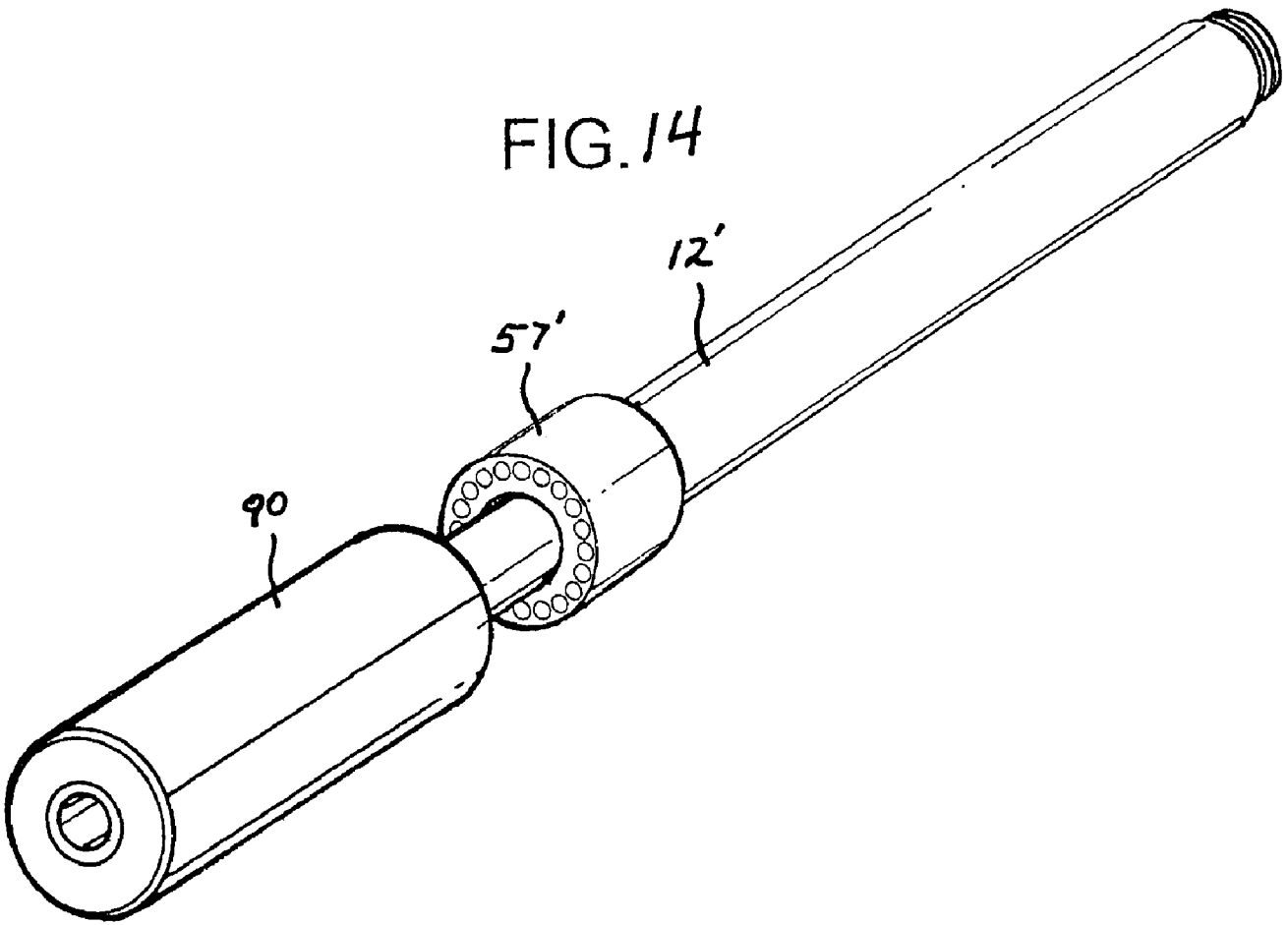
FIG. 14 is a perspective view illustrating a replacement barrel.

Employing the stabilizing hand guard system of the present invention permits barrel 12 to be easily and quickly changed simply by loosening forward wedge block 58 (disengaged position), and unscrewing barrel 12 from receiver 15. A replacement barrel can then be easily inserted. As can be seen with reference to FIG. 14, barrel 12 can be replaced with barrel 12'. Each barrel 12 and 12' will typically be prepared with a forward barrel guide 57 or 57' fixedly in position. A replacement barrel 12' can be of a different caliber, also requiring replacement of the bolt or bolt head and magazine to accommodate the new caliber, or the same caliber with additional accessories attached such as a suppressor 90. Additionally, once the hand guard system is substantially rigidly established and aligned, installment of a replacement barrel will result in an aligned barrel with no "zeroing" required. The replacement barrel, once tightened into position, will be aligned properly with support block 14 and thus through the inter-aligned elements to rail 75 and sighting devices carried thereon. In essence, the rearward barrel guide acts as a register for the entire rifle. One positioned, all the other elements can be removed or replaced and when replaced, will register with the rearward barrel guide.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A firearm comprising:

a support block having a forward end and a rearward end and carrying a receiver on a top surface thereof intermediate the forward end and the rearward end;

an engagement element at the forward end of the support block;

a rearward barrel guide having a thrust coupling extending radially outwardly therefrom, the thrust coupling engaging the engagement element thereby aligning the rearward barrel guide with the support block;

a barrel having a threaded breech end and a muzzle end, the threaded breech end received through the rearward barrel guide and threadably attached to the receiver; and a handguard assembly received over the barrel and coupled to the rearward barrel guide, stabilizing the barrel.

2. A firearm as claimed in claim 1 wherein the top surface of the support block includes a channel formed therein for receiving and positioning the receiver.

3. A firearm as claimed in claim 1 wherein the engagement element is a keyhole slot formed in the forward end of the support block, the keyhole slot receiving and aligning the thrust coupling and rearward barrel guide with the support block.

4. A firearm as claimed in claim 1 wherein the rearward barrel guide includes a tab extending from a rear surface thereof, the tab received in a slot formed in a forward surface of the receiver, aligning the rearward barrel guide with the receiver.

5. A firearm as claimed in claim 1 wherein the handguard assembly includes a rearward wedge block carried between an outer surface of the rearward barrel guide and an inner surface of the handguard, the rearward wedge block movable between a disengaged position and an engaged position wherein the rearward wedge block is forced against the rearward barrel guide in the engaged position, frictionally holding the handguard assembly to the rearward barrel guide.

6. A firearm as claimed in claim 1 further including a forward barrel guide fixed to the barrel intermediate the muzzle end and the breech end.

7. A firearm as claimed in claim 6 wherein the handguard assembly includes a forward wedge block carried between an outer surface of the forward barrel guide and an inner surface of the handguard, the forward wedge block movable between a disengaged position and an engaged position wherein the forward wedge block is forced against the forward barrel guide in the engaged position, frictionally holding the handguard assembly to the forward barrel guide.

8. A firearm as claimed in claim 6 wherein the handguard assembly comprises:

a rearward wedge block carried between an outer surface of the rearward barrel guide and an inner surface of the handguard, the rearward wedge block movable between a disengaged position and an engaged position wherein the rearward wedge block is forced against the rearward barrel guide in the engaged position, frictionally holding the handguard assembly to the rearward barrel guide; and a forward wedge block carried between an outer surface of the forward barrel guide and an inner surface of the handguard, the forward wedge block movable between a disengaged position and an engaged position wherein the forward wedge block is forced against the forward barrel guide in the engaged position, frictionally holding the handguard assembly to the forward barrel guide.

9. A firearm as claimed in claim 8 wherein the handguard assembly further comprises:

a handguard portion which is generally tubular with an inner surface defining an inner volume, a rearward end and a forward end;

a rail portion positioned along a top surface of the handguard portion and extends rearwardly past the rearward end thereof;

a channel formed in a bottom surface of the rail portion a portion of the channel defining part of the inner volume; and the forward wedge block and the rearward wedge block carried within the channel proximate the forward end and the rearward end of the handguard portion, respectively.

10. A firearm as claimed in claim 9 wherein the handguard assembly further includes an alignment mount coupled to a top of the receiver, the alignment mount is positioned in the channel of the rail portion extending rearwardly past the rearward edge of the handguard portion.

11. A barrel stabilizing system for a firearm including a barrel having a muzzle end and a threaded breech end threadably attached to a receiver, the barrel stabilizing system comprising:

an engagement element positioned relative the receiver;

a rearward barrel guide having a thrust coupling extending radially outwardly therefrom, the thrust coupling engaging the engagement element thereby aligning the rearward barrel guide with the receiver, the threaded breech end of the barrel extending through the rearward barrel guide and threadably attached to the receiver; and a handguard assembly received over the barrel and coupled to the rearward barrel guide, stabilizing the barrel.

12. A barrel stabilizing system for a firearm as claimed in claim 11 wherein the rearward barrel guide includes a tab extending from a rear surface thereof, the tab received in a slot formed in a forward surface of the receiver, the slot receiving the tab and aligning the rearward barrel guide with the receiver.

13. A barrel stabilizing system for a firearm as claimed in claim 11 wherein the handguard assembly includes a rearward wedge block carried between an outer surface of the rearward barrel guide and an inner surface of the handguard, the rearward wedge block movable between a disengaged position and an engaged position wherein the rearward wedge block is forced against the rearward barrel guide in the engaged position, frictionally holding the handguard assembly to the rearward barrel guide.

14. A barrel stabilizing system for a firearm as claimed in claim 11 further including a forward barrel guide fixed to the barrel intermediate the muzzle end and the breech end.

15. A barrel stabilizing system for a firearm as claimed in claim 14 wherein the handguard assembly includes a forward wedge block carried between an outer surface of the forward barrel guide and an inner surface of the handguard, the forward wedge block movable between a disengaged position and an engaged position wherein the forward wedge block is forced against the forward barrel guide in the engaged position, frictionally holding the handguard assembly to the forward barrel guide.

16. A barrel stabilizing system for a firearm as claimed in claim 14 wherein the handguard assembly comprises:

a rearward wedge block carried between an outer surface of the rearward barrel guide and an inner surface of the handguard, the rearward wedge block movable between a disengaged position and an engaged position wherein the rearward wedge block is forced against the rearward barrel guide in the engaged position, frictionally holding the handguard assembly to the rearward barrel guide; and a forward wedge block carried between an outer surface of the forward barrel guide and an inner surface of the handguard, the forward wedge block movable between a disengaged position and an engaged position wherein the forward wedge block is forced against the forward barrel guide in the engaged position, frictionally holding the handguard assembly to the forward barrel guide.

17. A barrel stabilizing system for a firearm as claimed in claim 16 wherein the handguard assembly further comprises:

a handguard portion which is generally tubular with an inner surface defining an inner volume, a rearward end and a forward end;

a rail portion positioned along a top surface of the handguard portion and extends rearwardly past the rearward end thereof;

a channel formed in a bottom surface of the rail portion a portion of the channel defining part of the inner volume; and the forward wedge block and the rearward wedge block carried within the channel proximate the forward end and the rearward end of the handguard portion, respectively.

18. A barrel stabilizing system for a firearm as claimed in claim 17 wherein the handguard assembly further includes an alignment mount coupled to a top of the receiver, the alignment mount is positioned in the channel of the rail portion extending rearwardly past the rearward edge of the handguard portion.

19. A barrel stabilizing system for a firearm as claimed in claim 11 further including a support block having a forward end and a rearward end and carrying the receiver on a top surface thereof intermediate the forward end and the rearward end.

20. A barrel stabilizing system for a firearm as claimed in claim 19 wherein the engagement element is a keyhole slot formed in the forward end of the support block, the keyhole slot receiving and aligning the thrust coupling with the support block.

* * * * *

UNITED STATES PATENT AND TRADEMARK OFFICE

CERTIFICATE OF CORRECTION

PATENT NO. : 7,905,041 B1
APPLICATION NO. : 11/864966
DATED : March 15, 2011
INVENTOR(S) : Robert B. Davies It is certified that error appears in the above-identified patent and that said Letters Patent is hereby corrected as shown below:

Column 5, Line 16: barrel nuts 57 and 54 should be "barrel guides 57 and 54"
Column 5, Line 49: barrel nuts 57 and 54 should be "barrel guides 57 and 54"

Signed and Sealed this
Third Day of July, 2012

David J. Kappos

David J. Kappos
*Director of the United States Patent and Trademark Office*